US012565838B2

(12) United States Patent
Sha et al.

(10) Patent No.: US 12,565,838 B2
(45) Date of Patent: Mar. 3, 2026

(54) EQUIPMENT AND APPLICATION METHOD FOR SINKAGE DETECTION AND ACTIVE ESCAPE OF DEEP-SEA MINING VEHICLE

(71) Applicant: Ocean University of China, Shandong (CN)

(72) Inventors: Fei Sha, Shandong (CN); Mingshuai Xi, Shandong (CN); Xuguang Chen, Shandong (CN); Shijiu Gu, Shandong (CN); Rui Fan, Shandong (CN); Hao Kong, Shandong (CN); Meng Bu, Shandong (CN)

(73) Assignee: Ocean University of China, Shandong (CN)

( * ) Notice: Subject to any disclaimer, the term of this patent is extended or adjusted under 35 U.S.C. 154(b) by 423 days.

(21) Appl. No.: 18/301,266

(22) Filed: Apr. 17, 2023

(65) Prior Publication Data

US 2023/0332503 A1 Oct. 19, 2023

(30) Foreign Application Priority Data

Apr. 19, 2022 (CN) ..... 202210407284.0

(51) Int. Cl.
*E21C 50/00* (2006.01)
*B63G 8/00* (2006.01)

(52) U.S. Cl.
CPC ..... *E21C 50/00* (2013.01); *B63G 8/001* (2013.01); *B63G 2008/004* (2013.01)

(58) Field of Classification Search
CPC .... E21C 50/00; B63G 8/001; B63G 2008/004
See application file for complete search history.

(56) References Cited

FOREIGN PATENT DOCUMENTS

| | | | | |
|---|---|---|---|---|
| CN | 109398007 A | * | 3/2019 | ..... B60F 3/0015 |
| CN | 110978917 | | 4/2020 | |
| CN | 111017058 A | * | 4/2020 | ..... E21C 50/00 |
| CN | 110952984 B | * | 12/2020 | ..... G01B 21/18 |

OTHER PUBLICATIONS

Office Action of China Counterpart Application, issued on Dec. 2, 2022, pp. 1-4.

* cited by examiner

*Primary Examiner* — Matthew R Buck
(74) *Attorney, Agent, or Firm* — JCIPRNET

(57) ABSTRACT

An equipment and application method for sinkage detection and active escape of deep-sea mining vehicle, comprising: the sinkage detection and warning devices and the self-escape equipment. The sinkage detection and warning devices are installed on the left and right sides of each track of the deep-sea mining vehicle, and it monitors the contact conditions between the tracks and the sediment, and the distance from the bottom of the track to the device is measured. The self-escape equipment comprises the active interactive grouting system, which connects to intelligent steering and retractable grouting heads. The intelligent steering and retractable grouting heads are also located on the left and right sides of each track. This invention can detect the complex driving environment of the seafloor automatically and combine the existing grouting technology and materials to achieve active grouting escape in case of excessive sinkage.

13 Claims, 7 Drawing Sheets

EQUIPMENT AND APPLICATION METHOD FOR SINKAGE DETECTION AND ACTIVE ESCAPE OF DEEP-SEA MINING VEHICLE

CROSS-REFERENCE TO RELATED APPLICATION

This application claims the priority benefit of China application no. 202210407284.0, filed on Apr. 19, 2022. The entirety of the above-mentioned patent application is hereby incorporated by reference and made a part of this specification.

BACKGROUND

Technical Field

This invention refers to an equipment and method for sinkage detection and active escape of deep-sea mining vehicle, which belongs to the equipment technical field of deep-sea mining in ocean engineering.

Description of Related Art

With the industrialization development, the total number of land-based mineral resources has decreased, the abundant marine mineral resources have started to draw people's attention. Approximately 75,000 $km^2$ of the polymetallic nodule exclusive area is owned by China in the CCZ, owning approximately 420 million tons of dry nodules, which is expected to create a deep-sea industry with an annual production capacity of three million tons of dry nodules and a 20-year mining cycle. Equipment development of deep-sea mining has great significance in the competition for deep-sea resources.

Polymetallic nodules (manganese nodules) are distributed broadly in abyssal plain at the depth of 4000-6000 m and deposited in the surface layer of sediment. The distribution conditions of polymetallic nodules are very different from general terrestrial conditions. The main features are: very soft substrate, low load-bearing capacity, high sensitivity (strength may be reduced by 80% after disturbance), and extremely fine sediment particles, ultra-small internal friction angle. Moreover, the abyssal plain is not flat completely, there are also low-lying places. The hydraulic crawler mining vehicle has gained widespread recognition both domestically and internationally. As the core part of the deep-sea mining system, the mining vehicle must drive stably on the soft surface of sediment.

As a result of the above, crawler mining vehicles may incline, sink, and be trapped when driving on seafloor due to low bearing capacity of deep-sea sediment, or the crawler mining vehicle may be trapped in low-lying places. When this happens to a deep-sea mining vehicle, it does not escape itself, mining operations will be interrupted and the mining system will be paralyzed. It will take significant losses to help the vehicle to escape the above situations. Existing structures of escape devices are complex, there are numerous steps and they are subjected to environmental influences easily. And they have many environment restrictions and failure rates. Meanwhile, there are no examples of existing escape devices combining with the seabed grouting technology. Therefore, it is urgent to combine the escape equipment and its application method with mature and efficient active grouting method to enhance the self-adapting driving capability of crawler mining vehicles on the deep-sea sediment and satisfy the requirements of actual deep-sea mining operations ultimately.

SUMMARY

In response to the above problems, this present invention provides an equipment and application method for sinkage detection and active escape of deep-sea mining vehicle. The equipment can detect the seabed complex environment automatically, combining with the mature and efficient grouting technology and materials to achieve automatic escape after grouting. The incline and sinkage problems caused by insufficient bearing capacity, and may be trapped in low-lying places has been solved effectively, and the adaptive driving capability of deep-sea mining vehicles has been improved.

An equipment for sinkage detection and active escape of deep-sea mining vehicle, comprising the sinkage detection and warning device and the self-escape equipment. Wherein the sinkage detection and warning device is installed on both sides of each track of the deep-sea mining vehicle, the device measures the distance from the bottom of the track to the device and monitors the contact condition of between the tracks and the sediment actively. Wherein the self-escape equipment comprising the interactive grouting system, which connects to some intelligent steering and retractable grouting heads, and the intelligent steering and retractable grouting heads are located on both left and right sides of each track of the deep-sea mining vehicle.

Further, the intelligent steering and retractable grouting heads have the rotation device, which connects to a horizontal telescopic mechanism. And the horizontal telescopic connects to a vertical telescopic mechanism.

Further, the active interactive grouting system, comprising the conveyor of A-B mixed slurry, the A-slurry tank and the B-slurry tank connect to the slurry inlet of the conveyor of A-B mixed slurry, and the intelligent steering and retractable grouting heads connect to the slurry outlet of the conveyor of A-B mixed slurry.

Further, there are several conveyors of A-B mixed slurry, each conveyor of A-B mixed slurry connects to an intelligent steering and retractable grouting head.

Further, the A-slurry tank and the B-slurry tank are inside the left and right tracks of the deep-sea mining vehicle respectively, and several conveyors of A-B mixed slurry are installed on the left and right sides of each slurry tank.

Further, the top of A-slurry tank connects to the A-slurry mixing and transfer pump, wherein the left and right sides of A-slurry tank connect to several A-slurry transfer pumps, and each A-slurry transfer pump connects to A-box side slurry mixing and transfer device.

Further, the top of B-slurry tank connects to the B-slurry mixing and transfer pump, wherein the left and right sides of B-slurry tank connect to several B-slurry transfer pumps, and each B-slurry transfer pump connects to B-box side slurry mixing and transfer device.

The A-slurry mixing and transfer pump connects to B-box side slurry mixing and transfer device, and the B-slurry mixing and transfer pump connects to A-box side slurry mixing and transfer device.

Further, the active interactive grouting system also comprises the water-supply box, which connects to the conveyor of A-B mixed slurry.

Further, the built-in valve of the water-supply line has been installed between the water-supply box and the conveyor of A-B mixed slurry.

Further, this invention provides a crawler driving method for sinkage detection and active escape of deep-sea mining vehicle, comprising:

Step (1): the sinkage detection and warning device is activated when the deep-sea crawler mining vehicle is operating on the seafloor sediment, and the device monitors the contact conditions between the tracks and the sediment actively, and the distance from the bottom of the track to the device is measured.

Step (2): when a deep-sea mining vehicle is trapped in sediment or in low-lying places, which means that the tracks are sinking and inclined, then the data measured by the sinkage detection and warning devices will change abnormally and the alarm signal will be sent to the control system of the mining vessel.

Step (3): when the sinkage detection and warning system alarms that deep-sea mining vehicle is inclined and trapped in sediment or low-lying places, the active interactive grouting system begins to operate: the A-slurry tank and the B-slurry tank which are located on both sides of the track, transfer the two slurries to the conveyor of A-B mixed slurry via pumping devices, and any conveyor of A-B mixed slurry is responsible for mixing the A-slurry with the B-slurry, and the A-B mixed slurry is then transferred to the connection pipeline of mixed slurry.

Step (4): when the sinkage detection and warning system alarms that deep-sea mining vehicle is inclined and trapped in sediment or low-lying places, the active interactive grouting system begins to operate, intelligent steering and retractable grouting head also begins to operate: the distance between the drop point of the grouting head and the underside of the track is adjusted by a horizontal telescopic mechanism, which steers and extends to the sediment or low-lying places within the rotation range under the walking track, and it comes to the grouting waiting period.

Step (5): when the conveyor of A-B mixed slurry in the active interactive grouting system completes the mixing of A-slurry and B-slurry, the mixed slurry is grouted into the sediment underneath the tracks through the intelligent steering and retractable grouting head, then the bearing capacity of sediment has been enhanced, the incline of deep-sea mining vehicle has been corrected and it can get out of trouble or go through the low-lying places safely, increase the adaptive driving ability of the deep-sea mining vehicle on the thin and soft substrate of the sea floor.

Step (6): When the grouting has been finished, the A-slurry and B-slurry do not interact, the built-in valve of the water-supply line opens and the water pump delivers the water from the water-supply box to the intelligent steering and retractable grouting head, which cleans the conveyor of A-B mixed slurry and the intelligent steering and retractable grouting head by water flushing to prevent blocking the pipe and facilitate the recycle of the intelligent steering and retractable grouting head, and it is ready for any situation that may require grouting again.

The intelligent steering and retractable grouting heads on both sides of the same support beam are regarded as a pair, which can work simultaneously. Any pair of intelligent steering and retractable grouting heads can work independently. The intelligent steering and retractable grouting heads can rotate in the installation plane, adjust the grouting location, which can expand the influence range of grouting. The intelligent steering and retractable grouting heads extend from the static state when working, and then they are inserted into the seabed sediment. The maximum elongation distance is 10-25 cm below the track. After the grouting, the grouting heads can be cleaned and recycled to prevent condensation and plugging, and they are prepared for the next possible grouting to achieve repeated grouting.

The slurry of A-slurry tank or the B-slurry tank has long-term stable performance, and the A-B mixed slurry has a short gelling time, with high early and late strength, high viscosity, and high interface bonding strength. This invention intends to use two-component polyurethane (PU) grouting material as the A-B mixed slurry. The A-slurry is prepolymer for castor oil, polyether diol, polyisocyanate (TDI), dibutyl ester made of NCO-based. The B-slurry is made up of MOCA, polyether diol and diluent.

The beneficial effects of this invention are as follows.

1. This invention is based on the characteristics of deep-sea sediment and can detect driving and sinkage of deep-sea mining vehicle. The conditions of incline, sinkage in sediment or being trapped in low-lying places can be warned to mining vessel by the sinkage detection and warning devices. Then the active grouting escape method can be adopted for the above-mentioned situations.

2. The functions of sinkage detection, warning to mining vessel and active grouting escape are automatic completely. The invention is convenient and efficient to response and remedy the adverse situations quickly. The ability to adapt to terrain conditions in the deep-sea is enhanced sufficiently.

3. The escape method of this invention combines with the grouting method, it can solve the problems of low shear strength, high strength loss by disturbance and low bearing capacity of deep-sea sediment effectively. The bearing capacity of the bottom contact surface of tracks can be enhanced, the ability of advancing over obstacles can be enhanced by grouting A-B type quick-setting slurry. Therefore, the collection operation efficiency of deep-sea mining vehicle can be improved.

4. The design of each intelligent steering and retractable grouting head makes relatively wide grouting influence range, and each pair of intelligent steering and retractable grouting head can work independently, which can reduce the consumption of slurry reasonably. After the grouting is completed, the grouting heads can be cleaned and recycled to prevent condensation and plugging, and the next possible grouting is prepared to achieve repeated grouting.

BRIEF DESCRIPTION OF THE DRAWINGS

In order to state the technical solution proposal more clearly in this application embodiment or in the prior art, the embodiment or Figures are introduced below briefly. The drawings are used in the technical description. Obviously, the drawings in the description below are just some embodiments in this present, for ordinary technical personnel in this field, other drawings are obtained from the inspirations of these drawings under the conditions of no creative labor.

Figure 1:
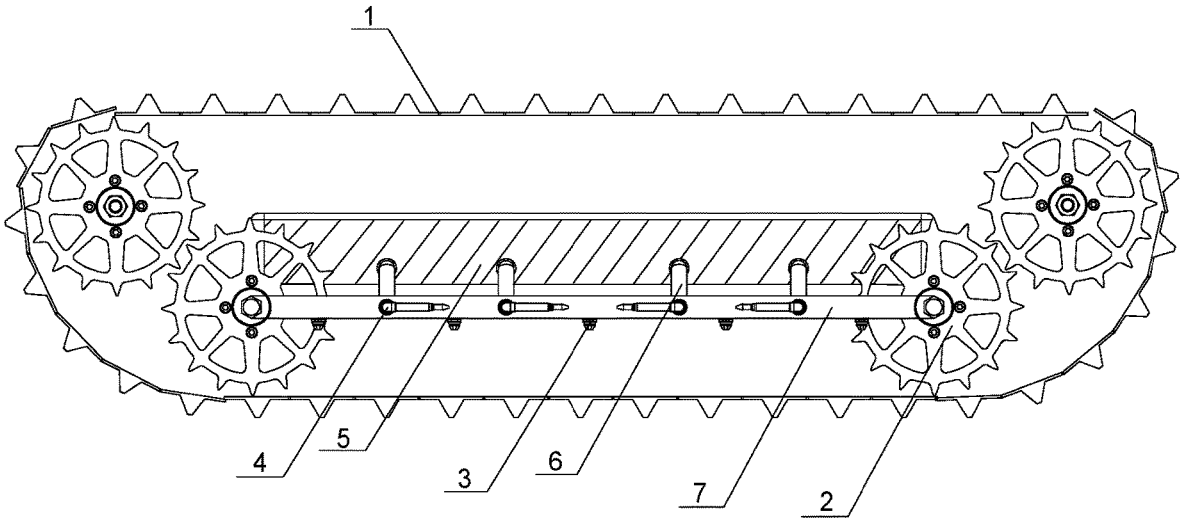
FIG. 1 shows the schematic diagram of the overall structure of the invention.

In Figures, 1 represents track of deep-sea mining vehicle, 2 represents drive gear, 3 represents sinkage detection and warning device, 4 represents intelligent steering and retractable grouting head, 5 represents active interactive grouting system, 6 represents the connection pipeline of mixed slurry, 7 represents support beam, 8 represents A-slurry tank, 9 represents B-slurry tank, represents A-slurry transfer pump, 11 represents B-slurry transfer pump, 12 represents connection and conveyance hose, 13 represents U-shaped transmission pipeline, 14 represents water pump, 15 represents water-supply line, 16 represents water-supply box, 17 represents A-box side slurry mixing and transfer device, 18 represents built-in valve of the water-supply line, 19 represents A-slurry mixing and transfer pump, 20 represents B-slurry mixing and transfer pump, 21 represents B-box side slurry mixing and transfer device.

In Figures, ① is the B-slurry, ② is the A-slurry, ③ is the A-B mixed slurry.

DESCRIPTION OF THE EMBODIMENTS

This invention will be further described below in conjunction with the Figures of examples, obviously, the described examples are only one part of this invention, but they are not all the examples. Based on embodiments of this invention, all other implementability examples acquired by ordinary skilled persons in the field without creative labor are within the protection scope of this invention.

Additionally, in this invention, it should be understood that the terms of "structure", "proportion", "size", etc. are used only to match the content disclosed in the specification, especially for the understanding and reading of people who are familiar with the technology, and the implementability condition of this invention is not limited, therefore, they are not significant meaning of all the techniques. Without departing from the above-mentioned technical idea of this invention, various replacements and changes are made according to common technical knowledge and conventional means shall be included in the protection scope of this invention in this field. At the same time, as quoted terms of "upper", "lower", "left", "right", "medium" and "one" in this specification, they are indicating orientations or positions based on the orientation or positional relationship shown in the drawings, they are only convenient for describing this invention and simplifying the description, and they do not indicate or imply that the referred device or element must have a specific orientation, the change of relative relationship or size adjustment can be regarded as the scope of this invention if there is not significant change of technical content.

Figure 3:
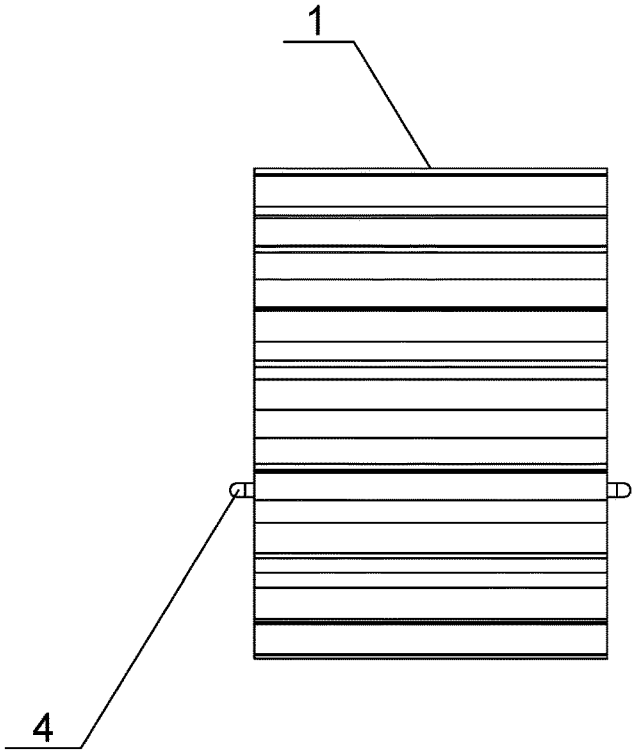
FIG. 3 shows the front view of the whole structure of the invention.

FIGS. 1 and 3 show the equipment for sinkage detection and active escape of deep-sea mining vehicle, comprising: track bracket, track of deep-sea mining vehicle (1), sinkage detection and warning device (3) and the active grouting escape equipment. The track of deep-sea mining vehicle (1) is provided with several grousers, each of which is perpendicular to the ground and it has an acute angle with the forward direction.

The sinkage detection and warning device (3) is a high precision laser detecting sensor. The intelligent steering and retractable grouting head (4), the active interactive grouting system (5) and the connection pipeline of mixed slurry (6) constitute the active grouting escape equipment.

The sinkage detection and warning device (high-precision laser detecting sensor) (3) is arranged on the support beam (7) of the crawler support and there are five on each side. The intelligent steering and retractable grouting heads (4) are arranged on the support beam (7), which is arranged at intervals with the sinkage detection and warning device (3). The support beam (7) has circular drilling holes. The connection pipeline of mixed slurry (6) connects to the intelligent steering and retractable grouting head (4) through the circular drilling hole, there are four on each side. The relationship between the connection pipeline of mixed slurry (6) and the intelligent steering and retractable grouting head (4) is in one-to-one correspondence.

Figure 2:
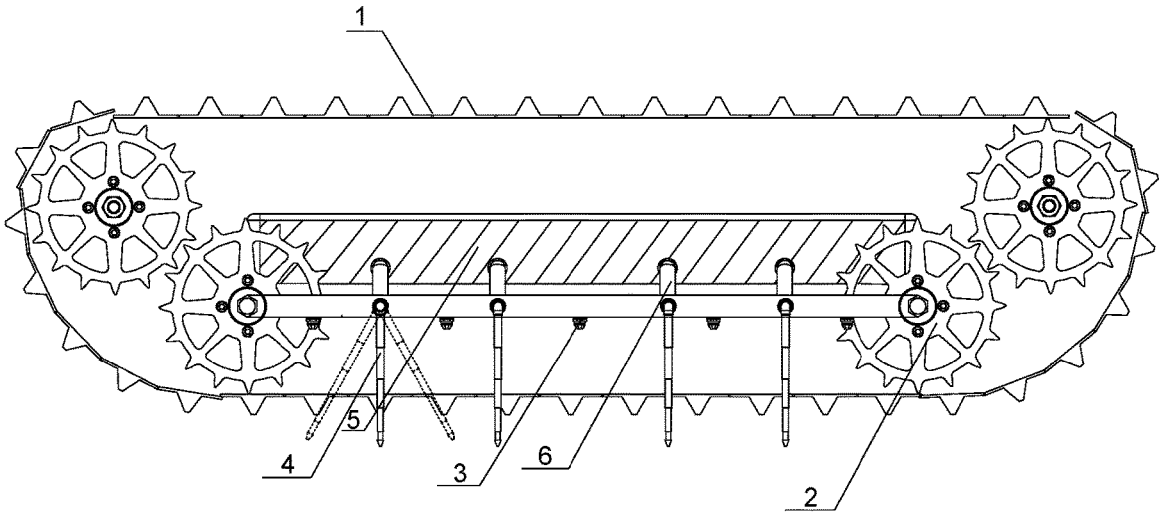
FIG. 2 shows the schematic diagram of grouting escape of the invention.
Figure 4:
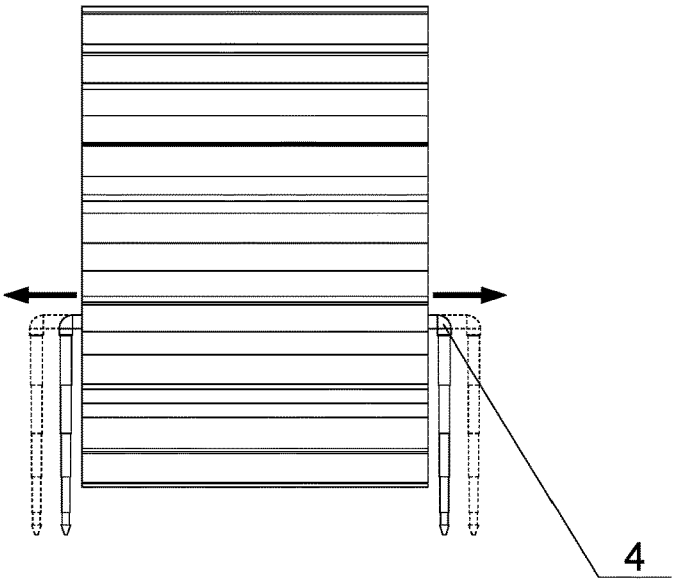
FIG. 4 shows the front view of the grouting escape of the invention.

FIGS. 2 and 4 show the operation condition of the sinkage detection and active escape equipment. The sinkage detection and warning devices (3) are activated when the deep-sea crawler mining vehicle is operating on the seafloor sediment, and the devices monitor the contact conditions between the tracks and the sediment actively, and the distance from the bottom of the track to the device is measured. When a deep-sea mining vehicle is trapped in sediment or in low-lying places, which means that the tracks are sinking and inclined, then the data measured by the sinkage detection and warning devices (3) will be sent to the control system of mining vessel.

When the alarm signal from the sinkage detection and warning devices (high-precision laser ranging sensor) (3) have been sent to the mining vessel, the intelligent steering and retractable grouting heads (4) steer, and then extend into the sediment, as shown in FIG. 4. The active interactive grouting system (5) works and the mixing of the A-slurry with the B-slurry has been completed. Then the mixed slurry is grouted into the sediment underneath track of deep-sea mining vehicle (1) along the connection pipeline of mixed slurry (6) via the intelligent steering and retractable grouting heads (4). The bearing capacity has been improved and the incline of the deep-sea mining vehicle has been corrected, which completes the escape of mining vehicle or through low-lying places safely.

Figure 5:
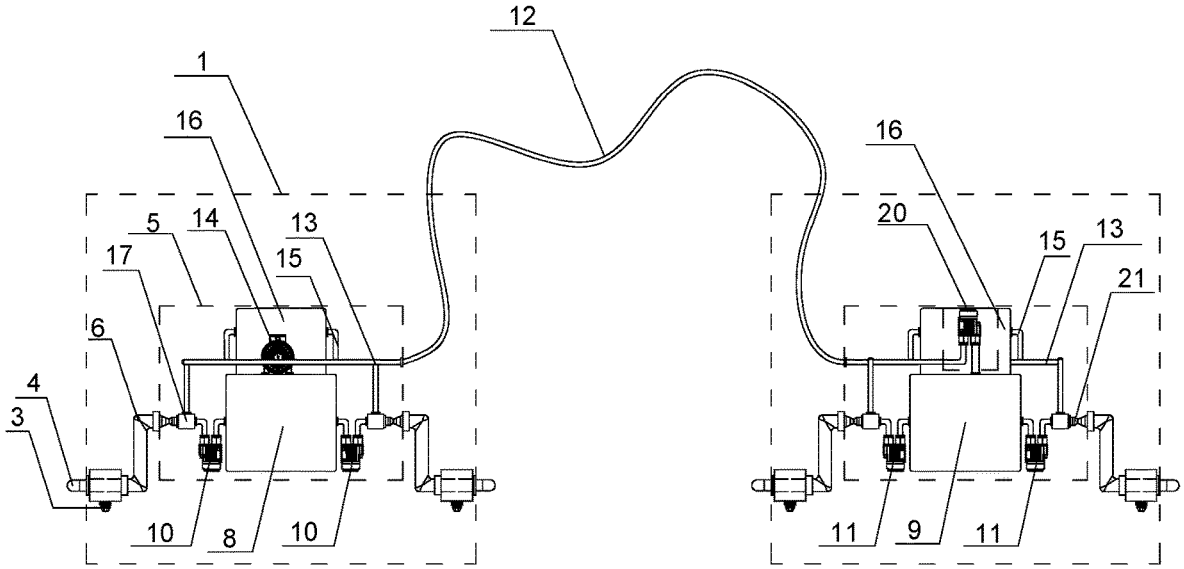
FIG. 5 shows the front view of the active interactive grouting system.
Figure 6:
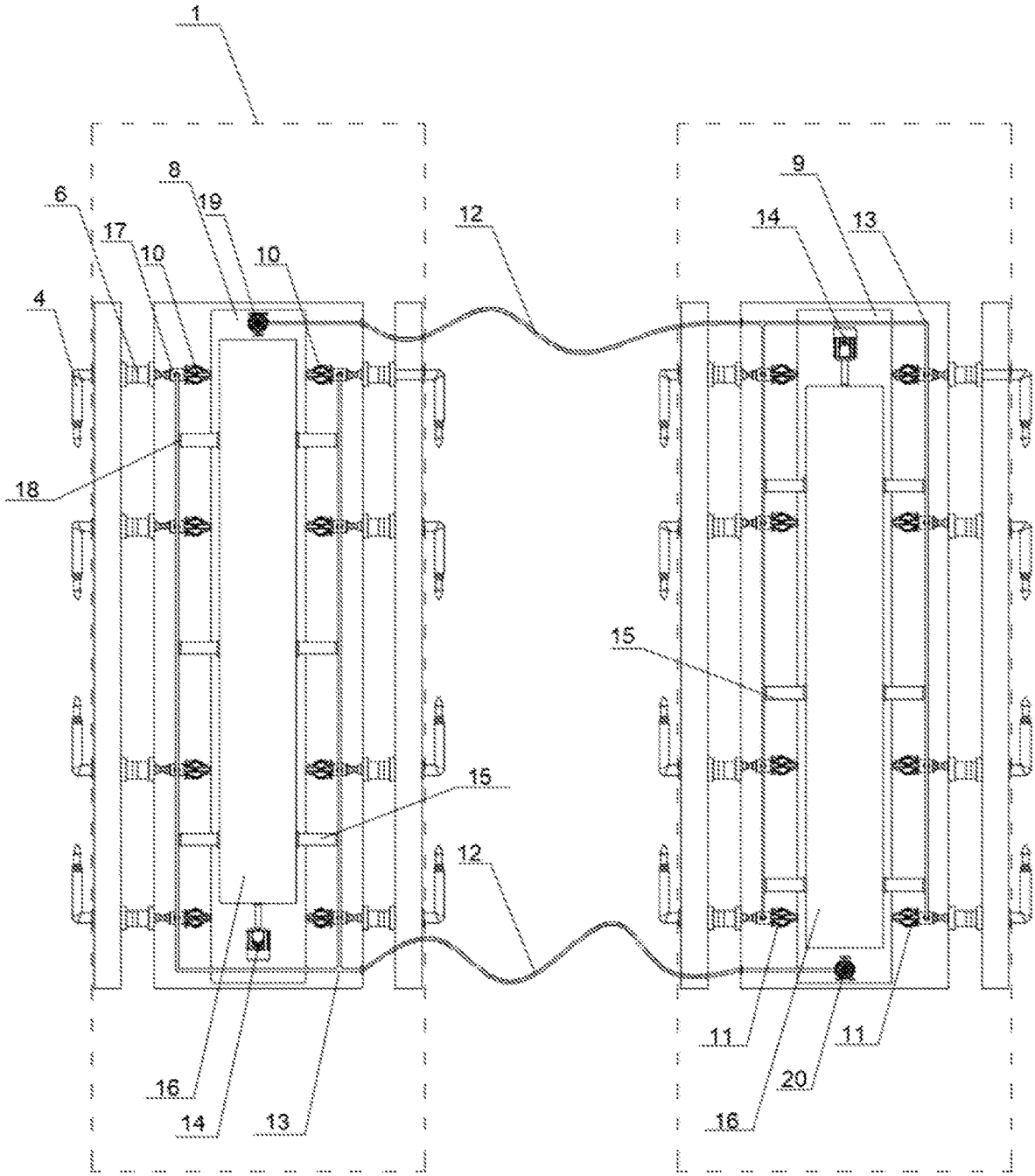
FIG. 6 shows the top view of the active interactive grouting system.
Figure 7:
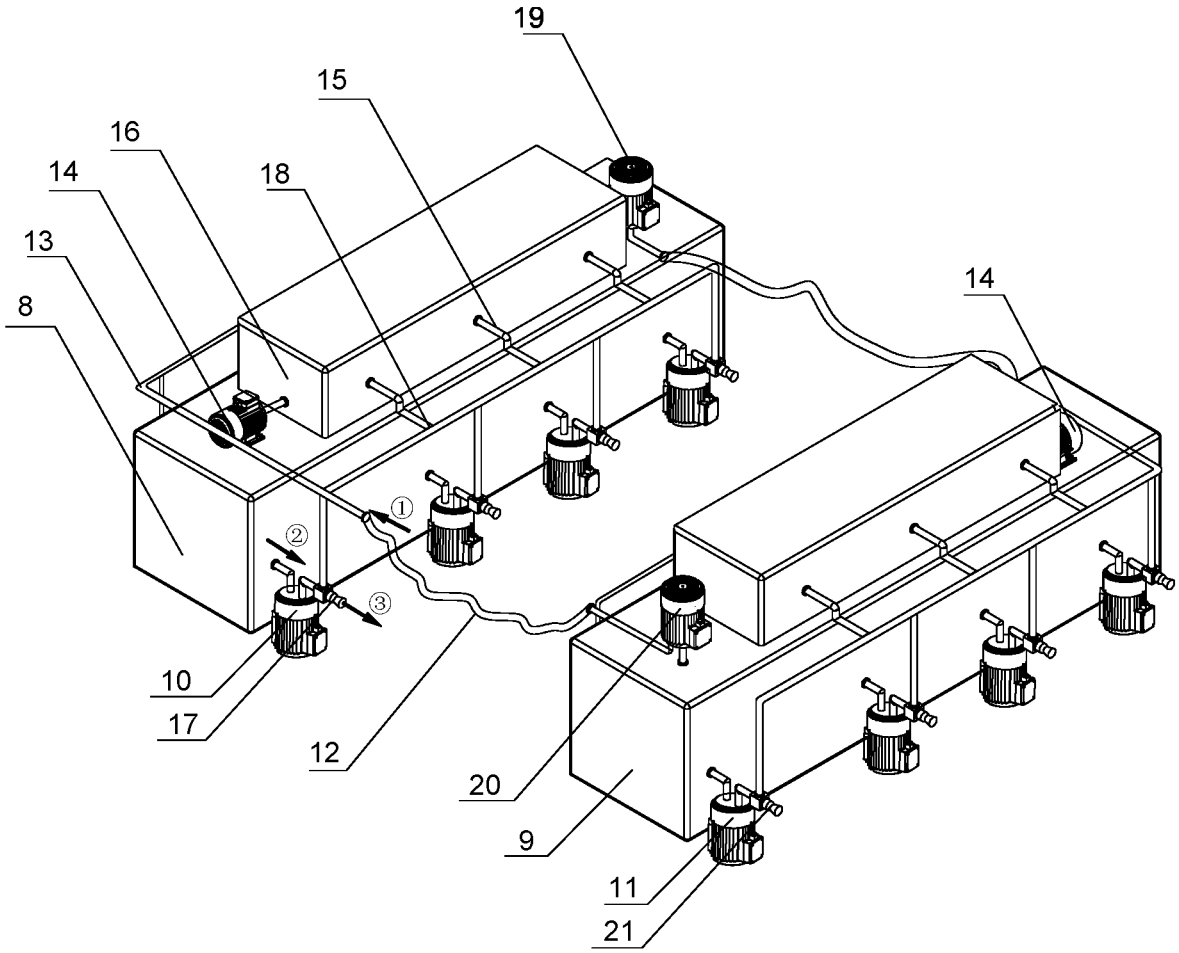
FIG. 7 shows the three-dimensional diagram of active interactive grouting system.

FIGS. 5-7 show the active interactive grouting system (5), comprising: A-slurry tank (8), B-slurry tank (9), A-slurry transfer pump (10), B-slurry transfer pump (11), connection and conveyance hose (12), U-shaped transmission pipeline (13), water pump (14), water-supply line (15), water-supply box (16), A-box side slurry mixing device (17), built-in valve of the water-supply line (18), A-slurry mixing and transfer pump (19), B-slurry mixing and transfer pump (20), B-box side slurry mixing and transfer device (21).

Figure 8:
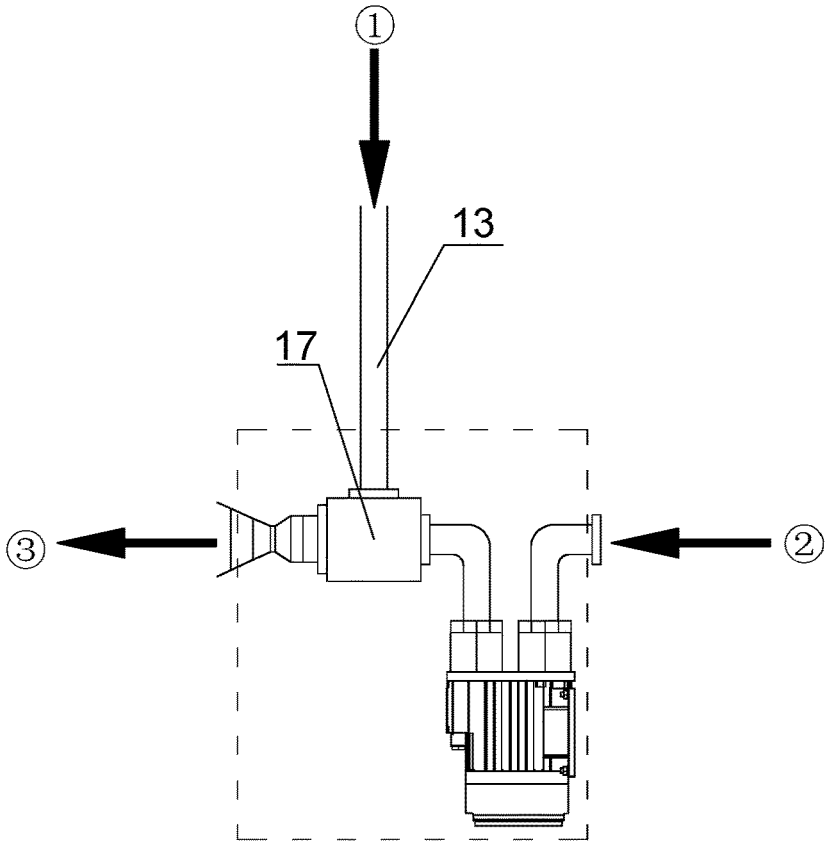
FIG. 8 shows the schematic diagram of conveyor of A-B mixed slurry.

A-slurry tank (8) and B-slurry tank (9) are placed in the left and right sides corresponding two track systems respectively. The connection and conveyance hose (12) connects to the A-slurry tank (8) and B-slurry tank (9) on both sides. There are two water-supply boxes (16), which are placed on A-slurry tank (8) and B-slurry tank (9) respectively. The left and right sides of A-slurry tank (8) connect to four A-slurry transfer pumps (10), and the slurry outlet of each A-slurry transfer pump (10) connects to A-box side slurry mixing and transfer device (17). A-box side slurry mixing device and transfer (17) connects to the connection pipeline of mixed slurry (6). The connection pipeline of mixed slurry (6) connects to the intelligent steering and retractable grouting head (4) through the circular drilling hole of the support beam (7). FIG. 8 shows A-box side slurry mixing and transfer device (17) is a device with two feeding ports, one of which connects to the A-slurry transfer pump (10), and the other connects to the U-shaped transmission pipeline (13). U-shaped transmission pipeline (13) connects to the B-slurry mixing and transfer pump (20), which is installed on the top of B-slurry tank (9). B-slurry ① in B-slurry tank (9) is transported to the A-box side slurry mixing device and transfer (17) through B-slurry mixing and transfer pump (20) and U-shaped transmission pipeline (13). Then the B-slurry ① and the A-slurry ② from A-slurry transfer pump (10) have been mixed in the A-box side slurry mixing and transfer device (17). The A-B mixed slurry ③ is transported to the intelligent steering and retractable grouting head (4) through the connection pipeline of mixed slurry (6).

The left and right sides of B-slurry tank (9) connect to four B-slurry transfer pump (11), and the slurry outlet of each B-slurry transfer pump (11) connects to B-box side slurry mixing and transfer device (21). B-box side slurry mixing and transfer device (21) connects to the connection pipeline of mixed slurry (6). The connection pipeline of mixed slurry (6) connects to the intelligent steering and retractable grouting head (4) through the circular drilling hole of the support beam (7). B-box side slurry mixing and transfer device (21) is a device with two feeding ports, one of which connects to the B-slurry transfer pump (11), and the other connects to the U-shaped transmission pipeline (13). U-shaped transmission pipeline (13) connects to the A-slurry mixing and transfer pump (19), which is installed on the top of A-slurry tank (8). A-slurry ② in A-slurry tank (8) is transported to the B-box side slurry mixing and transfer device (21) through A-slurry mixing and transfer pump (19) and U-shaped transmission pipeline (13). Then, the A-slurry ② and the B-slurry ① from B-slurry transfer pump (11) have been mixed in the B-box side slurry mixing device (21). The A-B mixed slurry ③ is transported to the intelligent steering and retractable grouting head (4) through the connection pipeline of mixed slurry (6).

The water pump (14) connects to water-supply box (16). The water-supply line (15) contains the built-in valve of the water-supply line (18), which connects to the water-supply box (16) and U-shaped transmission pipeline (13).

A-slurry tank (8) and B-slurry tank (9) on both sides communicate with the connection and conveyance hose (12) through their respective slurry mixing conveying pumps (A-slurry mixing pump (19) or B-slurry mixing pump (20)). Then mixed slurry is delivered to the conveyor of A-B mixed slurry on the other side through U-shaped transmission pipeline (13). Any conveyor of A-B mixed slurry is responsible for the mixing of A-slurry and B-slurry. After the mixing is completed, it is transported to the connection pipeline of mixed slurry (6) and the slurry was grouted into the sediment underneath the track of deep-sea mining vehicle (1) through the intelligent steering and retractable grouting heads (4).

When the grouting has been finished, the built-in valve of the water-supply line (18) of water-supply line (15) is opened and the water pump (14) delivers the water from the water-supply box (16) to the U-shaped transmission pipeline (13). The intelligent steering and retractable grouting head (4), U-shaped transmission pipeline (13), the connection pipeline of mixed slurry (6) and conveyor of A-B mixed slurry have been washed and cleaned to prevent blocking the pipe and facilitate the recovery of the intelligent steering and retractable grouting head (4), which is ready for any situation that may arise again that requires grouting.

FIG. 8 shows the work diagram of A-box side slurry mixing and transfer device (17). The A-box side slurry mixing and transfer device (17) receives the B-slurry ① from the B-slurry tank (9) brought by the U-shaped transmission pipeline (13), and the A-slurry ② brought by the A-slurry transfer pump (10) is received. Mixing is carried out in the A-box side slurry mixing and transfer device (17) to generate A-B mixed slurry ③, which is transported to the connection pipeline of mixed slurry (6) and it is used for grouting with the intelligent steering and retractable grouting head (4).

Figure 9:
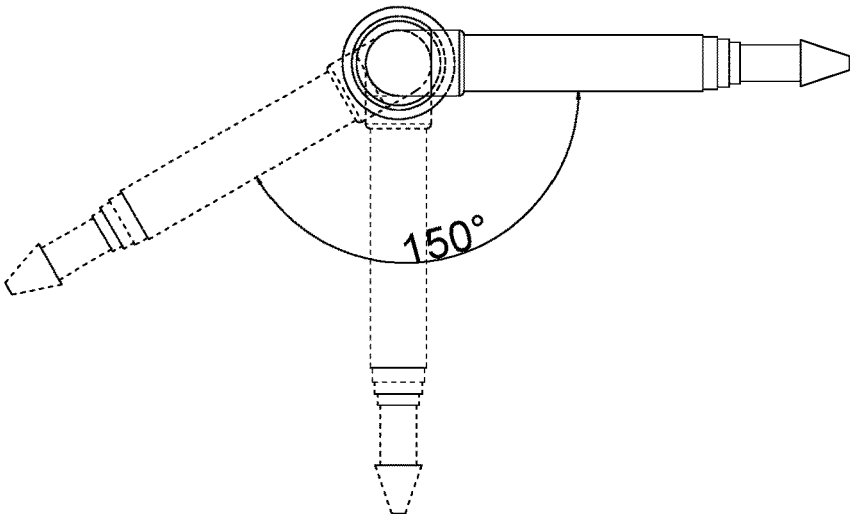
FIG. 9 shows the schematic diagram of rotating structure of intelligent steering and retractable grouting head.
Figure 10:
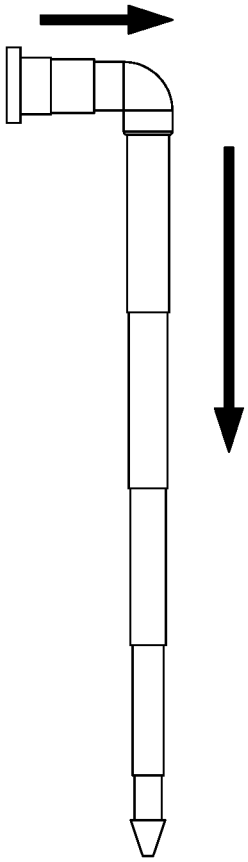
FIG. 10 shows the schematic diagram of the retractable structure of intelligent steering and retractable grouting head.
Figure 11:
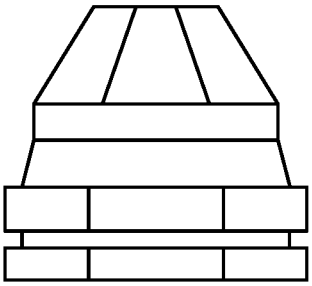
FIG. 11 shows the structure diagram of sinkage detection and warning device.

FIGS. 9 and 10 show the work schematic diagram of the retractable structure of intelligent steering and retractable grouting head (4). The intelligent steering and retractable grouting head (4) can be installed in the plane within the rotation range of 0-150°, and it can indicate the stretch in the arrow horizontal and vertical directions, and it is used to complete a certain range of grouting tasks.

Application Example 1

The sinkage detection and warning device is activated when the deep-sea crawler mining vehicle is operating on the seafloor sediment, and the sensors of device monitor the contact conditions between the tracks and the sediment actively, and the distance from the bottom of the track to the device is measured. When a left track system (one side of A-slurry tank) is trapped in sediment or in low-lying places, compared with the data measured by the high-precision laser ranging sensor on the right track, abnormal changes will occur in the data measured by the high-precision laser ranging sensor on the left track. The high-precision laser ranging sensor on the left track system will send an alarm signal to the control system of the mining vessel.

At this time, the active interactive grouting system begins to operate, the B-slurry stored by the B-slurry tank on the right side (B-slurry tank side) enters the U-shaped conveying pipe in the left caterpillar system (A-slurry tank side) through the connect and transport hose by the B-slurry mixing and transfer pump and then it is transmitted to the A-box side slurry mixing and transfer device in the left. At the same time, A-slurry carried by A-slurry tank on the left side (A-slurry tank side) is transported to the A-box side slurry mixing and transfer device through the A-slurry mixing and transfer pump, and then the A-B mixed slurry is formed, which is transported to the intelligent steering and retractable grouting head through the connection pipeline of mixed slurry.

While the active interactive grouting system is working, one or several pairs of intelligent steering and retractable grouting head enters to the operation conditions, to rotate into position and extend into the sediment below the track. After the mixed slurry is transported into the connection pipeline of mixed slurry, and then the intelligent steering and retractable grouting head will grout the AB-mixed-slurry into the sediment.

After the grouting, the bearing capacity of the sediment below is improved, the incline of deep-sea mining vehicle has been corrected and make it can get out of trouble safely, or through low-lying places.

When the grouting had been finished, the slurry A and slurry B do not interact, the built-in valve of the water-supply line opens and the water transfer pump machine delivers the water from the water-supply box to the intelligent steering and retractable grouting head, which cleans the conveyor of A-B mixed slurry and the intelligent steering and retractable grouting head by water flushing to prevent blocking the pipe and facilitate the recovery of the intelligent steering and retractable grouting head, and it is ready for any situation that may arise again that requires grouting.

The above claims are only preferred embodiments of this present application, and it is not intended to limit this present application. For the technical staff in this field, this invention can be changed variously. Any modification, equivalent replacement, improvement, etc. within the spirit and principles of this invention shall be within the protection scopes of this invention.

What is claimed is:

1. A crawler driving method for sinkage detection and active escape of a deep-sea mining vehicle, comprising:

step 1: sinkage detection and warning devices are activated when the deep-sea mining vehicle is driving and operating on a seafloor sediment, and the sinkage detection and warning devices monitor contact conditions between tracks and a sediment actively, and a distance from a bottom of the track to the sinkage detection and warning devices are measured;

step 2: when the deep-sea mining vehicle is trapped in the sediment or low-lying places, which means that the tracks are sunk and inclined, then a data measured by the sinkage detection and warning devices will change abnormally and an alarm signal will be sent to a control system of a mining vessel;

step 3: when the sinkage detection and warning devices alarm that the deep-sea mining vehicle is inclined and trapped in the sediment or the low-lying places, an active interactive grouting system begins to operate: a A-slurry tank and a B-slurry tank which are located on both sides of the track, transfer two slurries to a conveyor of a A-B mixed slurry via a pumping device, and the conveyor of the A-B mixed slurry is responsible for mixing a A-slurry with a B-slurry, and the A-B mixed slurry is then transferred to a connection pipeline of a mixed slurry;

step 4: when the sinkage detection and warning devices alarm that the deep-sea mining vehicle is inclined and trapped in the sediment or the low-lying places, the active interactive grouting system begins to operate, an intelligent steering and retractable grouting head also begins to operate: a distance between a drop point of the intelligent steering and retractable grouting head and a underside of the track is adjusted by a horizontal telescopic mechanism, which steers and extends to the sediment or the low-lying places within a rotation range under a walking track, and thereby entering a grouting waiting period;

step 5: when the conveyor of the A-B mixed slurry in the active interactive grouting system completes mixing of the A-slurry and the B-slurry, the mixed slurry is grouted into the sediment underneath the tracks through the intelligent steering and retractable grouting head along the connection pipeline of the mixed slurry, then a bearing capacity of the sediment has been enhanced, an incline of the deep-sea mining vehicle has been corrected and the deep-sea mining vehicle can get out of trouble or go through the low-lying places safely, increase an adaptive driving ability of the deep-sea mining vehicle on a thin and soft substrate of a sea floor;

step 6: when a grouting has been finished, the A-slurry and the B-slurry do not interact, a built-in valve of a water-supply line opens and a water transfer pump machine delivers a water from a water-supply box to the intelligent steering and retractable grouting head, which cleans the conveyor of the A-B mixed slurry and the intelligent steering and retractable grouting head by the water flushing to prevent blocking a pipe and facilitate a recycle of the intelligent steering and retractable grouting head, and the active interactive grouting system is ready for any situation that may arise again that requires grouting.

2. An equipment corresponding to the crawler driving method for sinkage detection and active escape of the deep-sea mining vehicle according to claim 1, comprising: the sinkage detection and warning devices and a self-escape equipment.

3. An equipment corresponding to the crawler driving method for sinkage detection and active escape of the deep-sea mining vehicle according to claim 1, wherein the sinkage detection and warning devices are installed on both sides of each of the tracks of the deep-sea mining vehicle, the sinkage detection and warning devices measure the distance from the bottom of the track to the sinkage detection and warning devices and monitors the contact condition of between the tracks and the sediment actively.

4. An equipment corresponding to the crawler driving method for sinkage detection and active escape of the deep-sea mining vehicle according to claim 1, wherein a self-escape equipment, comprising: the active interactive grouting system, which connects to a plurality of the intelligent steering and retractable grouting heads, and the intelligent steering and retractable grouting heads are located on both left and right sides of each of the tracks of the deep-sea mining vehicle.

5. The equipment corresponding to the crawler driving method for sinkage detection and active escape of the deep-sea mining vehicle according to claim 4, wherein the intelligent steering and retractable grouting heads have a rotation device, which connects to the horizontal telescopic mechanism, and the horizontal telescopic mechanism connects to a vertical telescopic mechanism.

6. The equipment corresponding to the crawler driving method for sinkage detection and active escape of the deep-sea mining vehicle according to claim 4, wherein the active interactive grouting system, comprising: the conveyor of the A-B mixed slurry, the A-slurry tank and the B-slurry tank connect to a slurry inlet of the conveyor of the A-B mixed slurry, and the intelligent steering and retractable grouting heads connect to a slurry outlet of the conveyor of the A-B mixed slurry.

7. The equipment corresponding to the crawler driving method for sinkage detection and active escape of the deep-sea mining vehicle according to claim 4, wherein there are many conveyors of the A-B mixed slurry, each of the conveyors of the A-B mixed slurry connects to one of the intelligent steering and retractable grouting heads.

8. The equipment corresponding to the crawler driving method for sinkage detection and active escape of the deep-sea mining vehicle according to claim 4, wherein the A-slurry tank and the B-slurry tank are inside a left of the tracks and a right of the tracks of the deep-sea mining vehicle respectively, and a plurality of the conveyors of the A-B mixed slurry are installed on a left side and a right side of each of the A-slurry tank and the B-slurry tank.

9. The equipment corresponding to the crawler driving method for sinkage detection and active escape of the deep-sea mining vehicle according to claim 4, wherein a top of the A-slurry tank connects to a A-slurry mixing and transfer pump, wherein a left side and a right side of the A-slurry tank connect to a plurality of A-slurry transfer pumps, and each of the A-slurry transfer pumps connects to a A-box side slurry mixing and transfer device.

10. The equipment corresponding to the crawler driving method for sinkage detection and active escape of the deep-sea mining vehicle according to claim 4, wherein a top of the B-slurry tank connects to a B-slurry mixing and transfer pump, wherein a left side and a right side of the B-slurry tank connect to a plurality of B-slurry transfer pumps, and each of the B-slurry transfer pumps connects to a B-box side slurry mixing and transfer device.

11. The equipment corresponding to the crawler driving method for sinkage detection and active escape of the deep-sea mining vehicle according to claim 4, wherein a A-slurry mixing and transfer pump connects to a B-box side slurry mixing and transfer device, and a B-slurry mixing and transfer pump connects to a A-box side slurry mixing and transfer device.

12. The equipment corresponding to the crawler driving method for sinkage detection and active escape of the deep-sea mining vehicle according to claim 4, wherein the active interactive grouting system also comprises the water-supply box, which connects to the conveyor of the A-B mixed slurry.

13. The equipment corresponding to the crawler driving method for sinkage detection and active escape of the deep-sea mining vehicle according to claim 12, wherein the built-in valve of the water-supply line has been installed between the water-supply box and the conveyor of the A-B mixed slurry.

* * * * *